US005634323A

United States Patent [19]

Podsiadlo

[11] Patent Number: 5,634,323

[45] Date of Patent: Jun. 3, 1997

[54] CARTON END PANEL FOLDING MECHANISM

[75] Inventor: James E. Podsiadlo, Walled Lake, Mich.

[73] Assignee: Elopak Systems A.G., Glattbrugg, Switzerland

[21] Appl. No.: 430,481

[22] Filed: Apr. 28, 1995

[51] Int. Cl.[6] ..... B65B 7/16

[52] U.S. Cl. ..... 53/484; 53/378.3; 493/184; 493/443; 493/452

[58] Field of Search ..... 53/484, 491, 476, 53/371.4, 371.5, 371.7, 378.3, 284.5; 493/184, 452, 165, 443, 442

[56] References Cited

U.S. PATENT DOCUMENTS

| | | | |
|---|---|---|---|
| 2,832,182 | 4/1958 | McGihon | 53/378.3 X |
| 2,883,917 | 4/1959 | La Bombard | 93/49 |
| 2,927,411 | 3/1960 | Kerr | 53/378.3 X |
| 3,501,889 | 3/1970 | Grulich et al. | 53/116 |
| 3,587,411 | 6/1971 | Theys et al. | 93/36.3 |
| 3,602,107 | 8/1971 | Zimmer et al. | 93/49 |
| 3,877,205 | 4/1975 | Gundersen | 53/378.3 X |
| 4,092,906 | 6/1978 | Linnér | 93/49 R |
| 4,119,018 | 10/1978 | Nava | 93/49 AC |
| 4,432,745 | 2/1984 | Eldridge | 493/10 |
| 4,539,002 | 9/1985 | Zak | 493/23 |
| 4,629,445 | 12/1986 | Toriyama | 493/10 |
| 4,747,813 | 5/1988 | Genoud et al. | 493/10 |
| 4,788,811 | 12/1988 | Kawajiri et al. | 493/165 X |
| 4,990,128 | 2/1991 | Murrah | 493/133 |
| 5,234,398 | 8/1993 | Larsen | 493/452 X |

*Primary Examiner*—James F. Coan

*Attorney, Agent, or Firm*—Reising, Ethington, Barnard & Perry

[57] ABSTRACT

A carton end panel folding mechanism for forcing both the leading and trailing panels of a gable top carton inwardly prior to the sealing of same. The folding mechanism includes four equally spaced blades, wherein each blade is shaped along its leading and trailing edges so as to be engaged at its trailing edge by a leading panel, forcing the leading panel inwardly and the blade forward, causing the leading edge of the next blade to engage the trailing panel and urge same inwardly.

18 Claims, 3 Drawing Sheets

CARTON END PANEL FOLDING MECHANISM

TECHNICAL FIELD

This invention relates generally to folding inwardly panels of end closures of cartons, particularly on forming, filling and sealing machines for thermoplastic coated paperboard cartons for liquid products, and, more particularly, to folding mechanisms for folding the leading and trailing end panels of tubular cartons being conveyed by a conventional conveyor.

BACKGROUND ART

Heretofore, carton end panel folding arrangements for folding the trailing panel of moving open-ended cartons have generally involved somewhat complex structures including many different components to accomplish the folding operation.

For example, Linner U.S. Pat. No. 4,092,906 includes a pair of oppositely rotating pins for engaging and folding front and rear flaps extending from boxes, the pins being driven by a plurality of cooperating gear wheels.

Bombard U.S. Pat. No. 2,883,917 illustrates a method and apparatus for folding trailing flaps as blanks travel in a straight line path through the machine. The apparatus includes a rotatable member having circumferential flap recesses formed therein and fingers with hooks extending substantially tangentially therefrom. While the conveyor pauses, the rotating hooks engage each trailing flap in turn and folds it forwardly through the adjacent flap recess.

Eldridge U.S. Pat. No. 4,432,745 discloses an apparatus for folding the trailing edge of paperboard blanks wherein arms with heads formed thereon rotate relative to a conveyor carrying the blanks such that the heads, while rotating, extend through openings in the conveyor to contact the trailing flaps of the blanks and fold them forwardly onto the respective blank bodies.

Toriyama U.S. Pat. No. 4,629,445 employs a rotatable claw mechanism for folding a rear portion of a blank, with an associated cam mechanism for changing the angular speed of the claw mechanism.

Genoud et al U.S. Pat. No. 4,747,813 discloses a further rotating arm and nose portion for engaging and folding a trailing flap as a blank moves along its path.

Zak U.S. Pat. No. 4,539,002 and Nava U.S. Pat. No. 4,119,018 each include two-blade units serving to fold the trailing flap only; and Theys et al U.S. Pat. No. 3,587,411 discloses oppositely disposed two-blade units for progressively folding two side panels and a front panel.

Zimmer et al U.S. Pat. No. 3,602,107 and Grulich et al U.S. Pat. No. 3,501,889 each include four-blade units, with Zimmer et al requiring two four-blade units to close the leading and trailing carton flaps, and Grulich et al's four-blade unit merely collapses a side of a cylindrical belt.

Murrah U.S. Pat. No. 4,990,128 discloses a single freely rotatable roller which serves to first fold rearwardly the leading panel of a tubular carton mounted on a rotating mandrel, and then to engage and fold the trailing panel forwardly as the carton rotates therepast.

DISCLOSURE OF THE INVENTION

A general object of the invention is to provide a simplified, yet efficient improved folding mechanism for folding the leading and trailing carton end panels of a carton mounted on a conveyor while the latter is being advanced.

Another object of the invention is to provide an improved leading and trailing carton end panel folding mechanism which is actuated upon engagement by the leading end panel.

A further object of the invention is to provide a leading and trailing carton end panel folding mechanism including a four-bladed former which is rotatably actuated upon one blade engaging and folding the leading end panel inwardly and the next blade engaging and folding the trailing end panel forwardly while the carton is moving.

A still further object of the invention is to provide an end panel folding mechanism which is adaptable to being mounted on existing carton forming, filling and sealing machines, either as original equipment, or as replacement aftermarket equipment.

These and other objects and advantages will be more apparent when reference is made to the following drawings and the accompanying description

BEST MODE OF CARRYING OUT THE INVENTION

Figure 1:
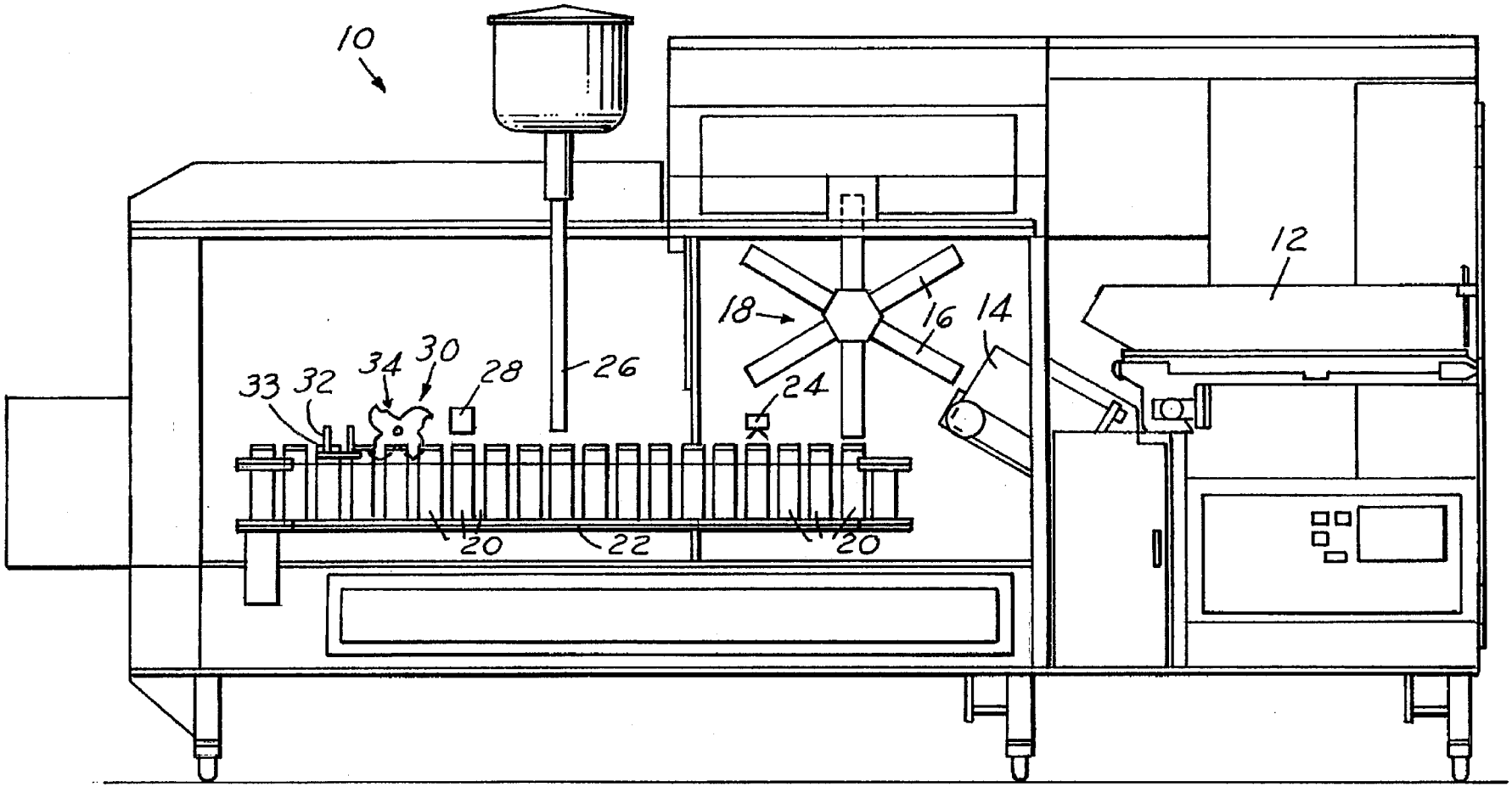
FIG. 1 is a side elevational view of a forming, filling and sealing machine embodying the invention.

Referring now to the drawings in greater detail, FIG. 1 illustrates a carton forming, filling and sealing machine 10 on which flat carton blanks 12 are formed into open-ended tubes 14 for loading onto mandrels 16 of an indexing turret 18 for bottom closure forming and sealing in the conventional manner. After the bottom closure panels have been closed and sealed on the mandrels, the bottom-sealed open top cartons 20 are stripped from the respective mandrels 16 and progressively received in suitable pockets on an indexable conveyor 22.

Once on the conveyor 22, the open top cartons 20 are conveyed in line through a pre-breaker station 24, a filling station 26, a top closure heating station 28, a closing station 30 and converging rails 32 leading to a sealing station 33, prior to discharge.

Figure 2:
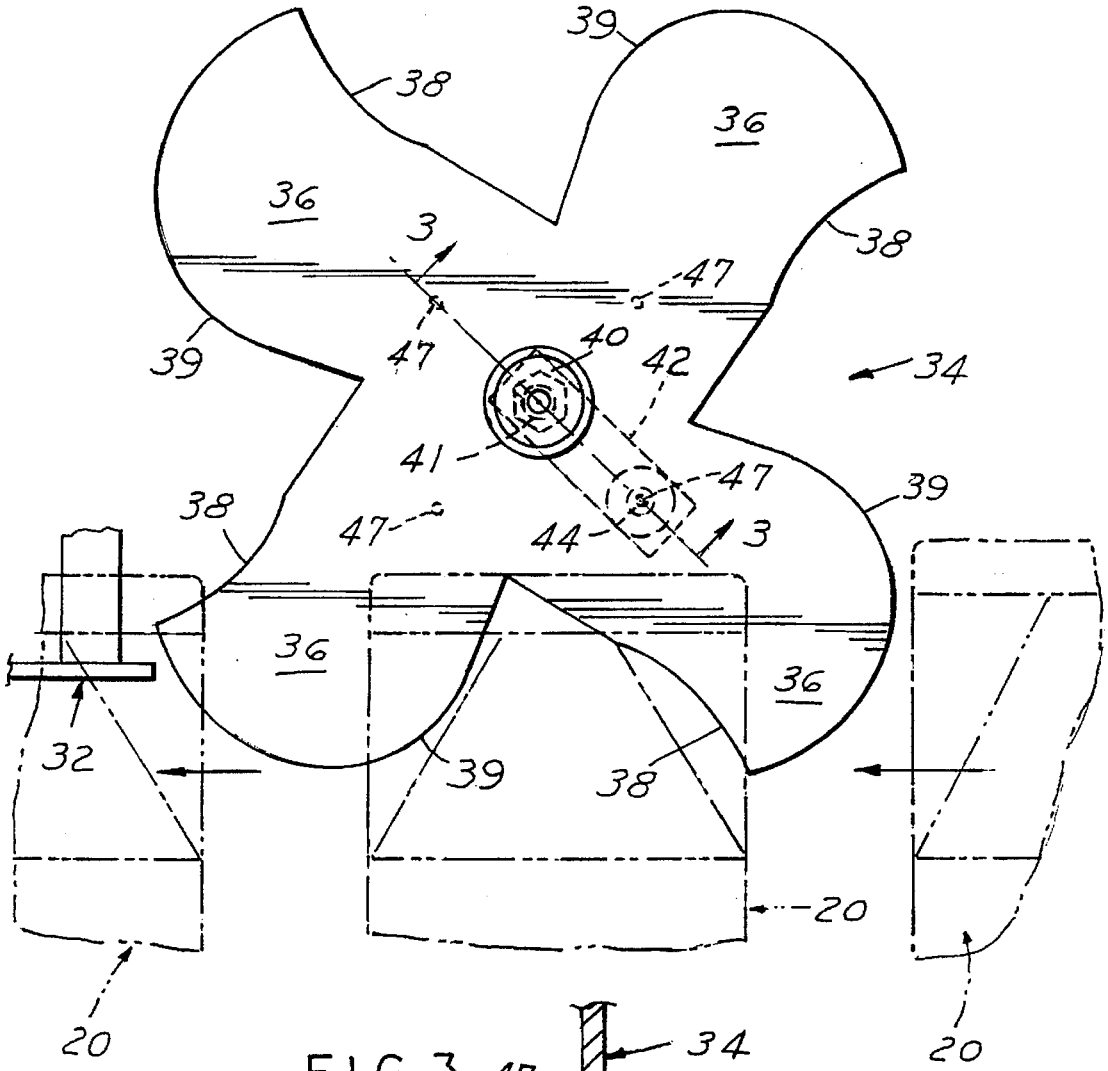
FIG. 2 is a side elevational view of the inventive carton end panel folding mechanism included on the FIG. 1 machine.
Figure 3:
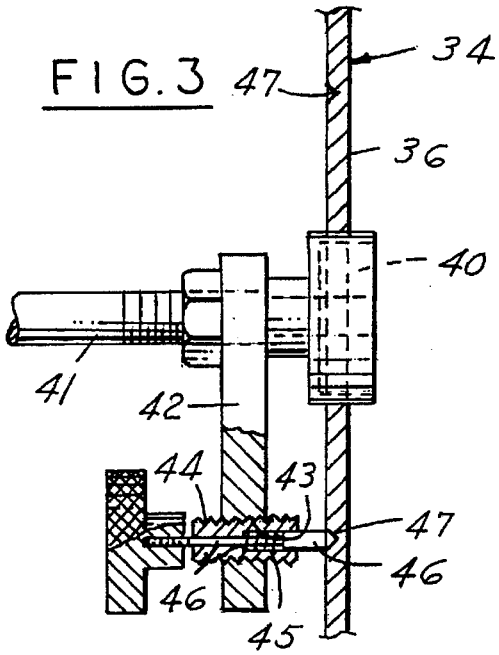
FIG. 3 is an enlarged cross-sectional view taken along the plane of the line 3—3 of FIG. 2, and looking in the direction of the arrows.

A rotary carton end folding mechanism 34, shown in FIG. 2 and in the form of a spider, is mounted at the closing station 30. The carton end folding mechanism 34 includes four blades 36, each of which has a concave-shaped leading edge 38 and a convex-shaped trailing edge 39 for purposes to be described. The mechanism 34 has a bearing 40 fitted in an opening at its center. The bearing 40 is freely rotatably mounted on a fixed shaft 41 (FIG. 3). A block 42 is fixedly secured at one end thereof on the shaft 41. As shown in FIG. 3, a threaded opening 43 is formed through the block 42 adjacent the other end thereof. A hollow threaded member 44 is mounted through the opening 43. A coil spring 45 is mounted through the hollow member 44 around a slidably mounted stem 46. The end of the stem 46 is adapted to enter any one of four equiangularly spaced recesses 47 formed in selected locations in the respective blades 36 adjacent the hub of the mechanism 34, as will be explained. When desired, the threaded member 44 may be threadedly adjusted in the opening 43.

Figure 5:
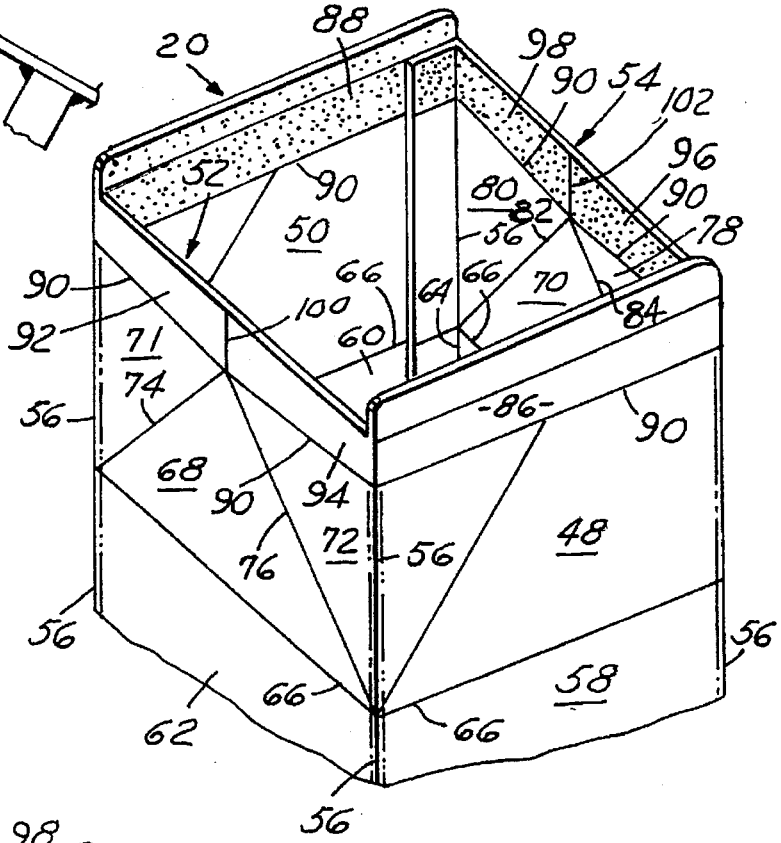
FIG. 5 is a fragmentary perspective view of an open carton top closure arrangement which is to be closed by the FIGS. 2, 3 and 4 structures.

Referring now to FIG. 5, the open top carton is seen to include four end closure panels 48, 50, 52 and 54 connected together by vertical score lines 56, and to four side panels 58, 60, 62 and 64, respectively, by horizontal score lines 66. The carton 20 is adapted to be folded into a conventional "gable top" configuration.

The panels 48 and 50 are adapted to become outer closure panels after folding and sealing, overlapping infolded closure panels 52 and 54. The latter panels 52 and 54 each include respective central triangular segments 68 and 70, with triangular segments 71 and 72 connected to the central triangular segment 68 by respective diagonal score lines 74 and 76, and triangular segments 78 and 80 connected to the central triangular segment 70 by respective diagonal score lines 82 and 84.

Sealing panels 86 and 88 are connected by horizontal score line 90 to the respective outer closure panels 48 and 50. Sealing fins 92, 94, 96 and 98 are connected by the horizontal score lines 90 to the respective triangular segments 71, 72, 78 and 80. Vertical score lines 100 and 102 connect the pairs of fins 92/94 and 96/98. A continuation of each of the vertical score lines 56 serves to connect the adjacent side panels.

In operation, the open top cartons 20 (FIG. 5) are indexed by the conveyor 22 into and past the pre-breaker station 24, the filling station 26, and the heating station 28, for the usual pre-breaking of the top closure score lines, the filling of the cartons with a selected liquid, and the heating of the usual polyethylene coating. Thereafter, the cartons 20 are indexed into the closing station 30, where they encounter the folding mechanism 34.

Specifically, the first-in-line carton 20 engages the convex edge 39 of one of the blades 36 of the freely rotatable folding mechanism 34. This causes the first blade 36 to rotate, simultaneously pushing the stem 46 out of the recess 47, against the force of the spring 45, while the blade rotates and forces the leading triangular segments 68, 71 and 72 and the sealing fins 92 and 94 inwardly, as shown in FIG. 6.

Figure 6:
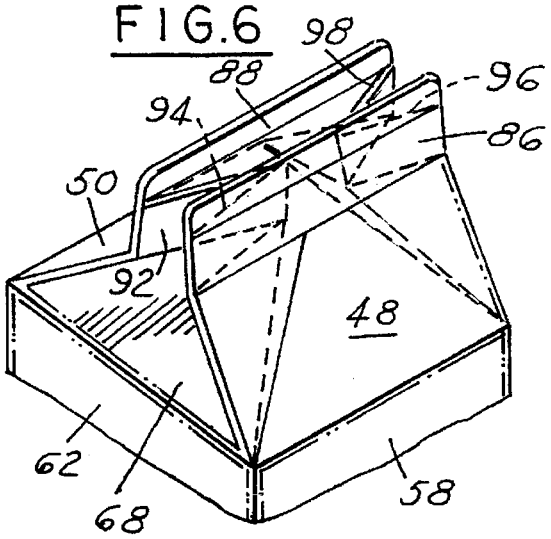
FIG. 6 is a fragmentary perspective view of the FIG. 5 carton top closure arrangement in a substantially closed configuration, by virtue of having been conveyed past the FIG. 2 and 3 structure.

The size and shape of each blade 36 is such that the concave-shaped edge 38 of the second blade engages the trailing triangular segments 70, 78 and 80 and the sealing fins 96 and 98, forcing them inwardly toward the oppositely disposed leading segments 68, 71 and 72 and the fins 92 and 94, as also shown in FIG. 6. The cycle then repeats, with the convex edge 39 of the second blade 36 acting against the leading segments of the next-in-line carton 20, and so on.

The stem 46 moves out of one recess 47 and then, against the force of the spring 45, the next recess moves towards it and receives it for each cycle. At the conclusion of the last cycle in each production run, the stem 46 will seat in one of the recesses 47, thereby positioning the blades 36 in an exactly correct orientation, ready for the next production run, without any possibility of causing a jam when encountered by the first-in-line open top carton 20.

Figure 4:
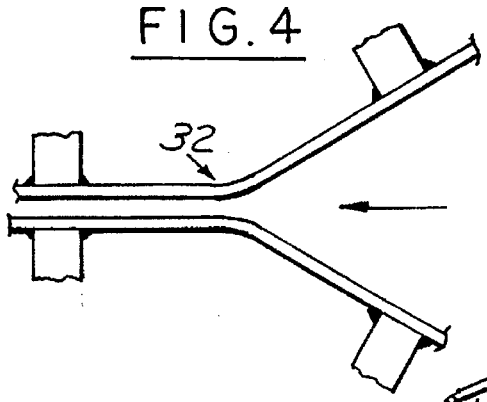
FIG. 4 is an enlarged plan view of a pair of guide rails leading to a sealing station of the FIG. 1 machine.
Figure 7:
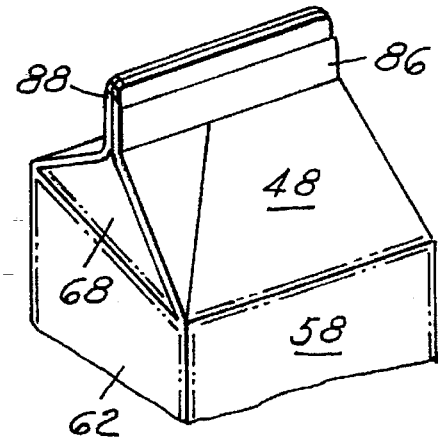
FIG. 7 is a fragmentary perspective view of the FIG. 4 carton top closure arrangement after being completely closed and sealed.

A result of the above described folding action is that each pair of sealing fins 92/94 and 96/98 has been folded toward one another, thereby pulling the outer sealing fins 88 and 86 towards the outer sides of the inner fins 92 and 98, and 94 and 96, respectively. In this condition, the now closely adjacent sealing fins enter the converging rails 32 (FIG. 4) of the sealing station 33 to become completely folded together, and there sealed by jaws, to attain the condition shown in FIG. 7, ready for discharge from the machine 10.

Industrial Applicability

It should be apparent that the invention provides a simple, compact, and efficient self-actuating forming mechanism for gable top, polyethylene coated, liquid-carrying cartons.

It should be further apparent that the leading and trailing edges 38 and 40, respectively, may be varied in shape and size so as to be suitable for different size cartons.

The rotary spider may be driven from some source of power, for example a drive shaft, other than the cartons themselves.

The rotary spider may be replaced by a rotary conveyor in the form of an endless belt or chain extending over pulleys or sprockets and carrying outwardly protruding arms which enter among the carton end closures.

While but one embodiment of the invention has been shown and described, other modifications thereof are possible within the scope of the following claims.

What is claimed is:

1. In combination, a folding station whereas leading and trailing panels of end closures of cartons are folded inwardly, conveying means for conveying said cartons in turn past said folding station, arm means at said station and insertable between first and second adjacent cartons proceeding the first before the second through said station, and rotary means from which said arm means protrudes and which advances said arm means as a unit in an endless path in such manner that said arm means is inserted between said first and second adjacent cartons and folds inwardly the trailing panel of the end closure of the first carton and the leading panel of the end closure of the second carton.

2. A combination according to claim 1, wherein said rotary means is driven by the cartons passing through said folding station.

3. A combination according to claim 2, and further comprising second arm means which protrudes from said rotary means at said station, proceeds as a unit in said endless path after the first arm means and is insertable between said second carton and a third carton proceeding through the station after the second carton and whereby the trailing panel of the end closure of the second carton and the leading panel of the end closure of the third carton are folded inwards.

4. A combination according to claim 3, and further comprising at least third arm means which protrudes from said rotary means at said station, proceeds as a unit in said endless path after said second arm means, and is insertable between said third carton and a fourth carton proceeding through the station after the third carton and whereby the trailing panel of the end closure of the third carton and the leading panel of the end closure of the fourth carton are folded inwards.

5. A combination according to claim 4, wherein the arm means are directly driven along said endless path by the leading panels.

6. A combination according to claim 5, wherein the arm means constitute a spider mounted so as to be freely rotatable on a fixed shaft.

7. A combination according to claim 1, wherein the arm means is formed with a substantially convexly curved trailing edge and a substantially concavely curved leading edge.

8. A combination according to claim 2, and further comprising detent means operatively connected to said rotary means for restartably stopping said rotary means in a correct position at the conclusion of a production run in preparation for the next production run without the possibility of a carton jam.

9. A combination according to claim 5, and further comprising detent means operatively connected to said rotary means for restartably stopping said rotary means in a correct position at the conclusion of a production run in preparation for the next production run without the possibility of a carton jam, said detent means including a recess formed in each arm means, a longitudinal block fixedly secured at one end thereof to said shaft and extended at a predetermined angle therefrom, a threaded opening formed through the block adjacent the other end thereof, a hollow threaded member mounted through said opening, and a spring-loaded stem slidably mounted in said hollow member and adapted to engage each of the recesses during the rotation of said carton end folding mechanism.

10. A combination according to claim 9, wherein said hollow threaded member is adjustable in said threaded opening in said block.

11. A combination according to claim 1, wherein said arm means comprises a blade extending in a plane of conveying of said cartons.

12. A method comprising conveying cartons in turn through a folding station; and folding inwardly leading and trailing panels of end closures of said cartons at said folding station by advancing arm means as a unit in an endless path, inserting said arm means at said station between first and second adjacent cartons proceeding the first before the second through said station, and bringing said arm means to bear upon the trailing panel of the end closure of the first carton and upon the leading panel of the end closure of the second carton.

13. A method according to claim 12, wherein said arm means is driven along said endless path by the cartons passing through said station.

14. A method according to claim 12, and further comprising advancing second arm means as a unit in said endless path after the first arm means, inserting said second arm means between the second carton and a third carton proceeding through the station after the second carton, and bringing said second arm means to bear upon the trailing panel of the end closure of the second carton and the leading panel of the end closure of the third carton to fold the same inwards.

15. A method according to claim 14, and further comprising advancing third arm means as a unit in said endless path after the second arm means, inserting said third arm means between the third carton and a fourth carton proceeding through the station after the third carton, and bringing said third arm means to bear upon the trailing panel of the end closure of the third carton and the leading panel of the end closure of the fourth carton to fold the same inwards.

16. A method according to claim 15, wherein the arm means are directly driven along said endless path by the leading panels.

17. A method according to claim 13, and further comprising restartably stopping rotary means including said arm means in a correct position at the conclusion of a production run in preparation for the next production run.

18. A method according to claim 15, and further comprising restartably stopping rotary means including the first, second and third arm means in a correct position at the conclusion of a production run in preparation for the next production run.

* * * * *